US005354186A

United States Patent [19]

Murtuza et al.

[11] Patent Number: 5,354,186

[45] Date of Patent: Oct. 11, 1994

[54] MACHINE BALANCER WITH PERISTALTIC FLUID PUMP

[75] Inventors: Syed Murtuza, W. Bloomfield; Luiz V. Boffi, Dearborn, both of Mich.

[73] Assignee: The Board of Regents of the University of Michigan, Ann Arbor, Mich.

[21] Appl. No.: 105,738

[22] Filed: Aug. 12, 1993

[51] Int. Cl.[5] ..... F04B 43/08; B24B 41/04

[52] U.S. Cl. ..... 417/474; 74/573 F; 451/343

[58] Field of Search ..... 417/474–477; 74/573 F, 573 R; 51/169

[56] References Cited

U.S. PATENT DOCUMENTS

| | | | |
|---|---|---|---|
| 3,248,967 | 5/1966 | Lewis | 74/573 F |
| 3,950,897 | 4/1976 | Birkenstock et al. | 51/169 |
| 3,967,416 | 7/1976 | Birkenstock et al. | 51/169 |
| 4,002,086 | 1/1977 | Reinhall | 74/573 F |
| 4,050,195 | 9/1977 | Hofmann | 51/169 |
| 4,255,163 | 3/1981 | Sonderegger et al. | 51/169 |
| 4,295,387 | 10/1981 | Zmivotov | 74/573 F |
| 4,432,253 | 2/1989 | Kerlin | 74/573 B |
| 4,445,398 | 5/1989 | Kerlin | 74/573 B |
| 4,537,177 | 8/1985 | Steere et al. | 125/13 R |
| 4,637,171 | 1/1987 | Menigat et al. | 51/281 R |
| 4,688,355 | 8/1987 | Menigat et al. | 51/169 |
| 4,705,464 | 11/1987 | Arimond | 417/477 |
| 4,905,419 | 3/1990 | Makarov et al. | 51/169 |
| 4,928,548 | 5/1990 | Lulay | 74/573 F |
| 4,951,526 | 8/1990 | Linder | 74/573 R |

*Primary Examiner*—Richard A. Bertsch
*Assistant Examiner*—Peter Korytnyk
*Attorney, Agent, or Firm*—Rohm & Monsanto

[57] ABSTRACT

A balancer arrangement for a rotating machine element employs a peristaltic pump which pumps a balancing fluid to respective balancing chambers via flexible tubing. In an arrangement which employs four balancing chambers, two peristaltic pumps may be employed to control the flow of balancing fluid between respective pairs of the chambers. The radial positioning of the peristaltic pumps is not fixed, but may be selected in response to specific characteristics of the application. In addition, the pump motors may be configured to drive the peristaltic pump rollers by operation of the rotation of the motor shaft, or the motor housing. The tubing along which the balancing fluid is conducted need not have a circular cross-section, and may be installed in a groove or cavity of the balancing arrangement so as to secure against centrifugal forces and prevent ballooning effects. Variations in air pressure which are developed amongst the balancing chambers by operating of the delivery and withdrawal of balancing fluid are equalized via capillary passages which interconnect ones of the balancing chambers.

21 Claims, 7 Drawing Sheets

MACHINE BALANCER WITH PERISTALTIC FLUID PUMP

BACKGROUND OF THE INVENTION

1. Field of the Invention

This invention relates generally to arrangements and systems for balancing rotating machinery, and more particularly, to a system and apparatus which employs fluid mass for balancing rotating equipment, such as a grinding wheel.

2. Description of the Related Art

Numerous efforts have been made in the prior art to achieve a dynamic balance of a rotating machine part. In a number of such prior art efforts, a plurality of chambers are arranged on the rotating part, and fluid is injected into the chambers, in a respective quanta, to achieve the desired balance.

In some prior art arrangements, compensation for imbalance is effected by a mechanical system which employs compensating weights. The adjustment of the compensating weights is achieved, in one known system, by placing the weights in respective cylinders having circular cross-section, but their axis follow a circular line. Balancing is achieved during rotation of the machine part by moving the weights along their respective cylinders. Such motion is achieved by applying fluid pressures at opposite ends of each cylinder, whereby the weight is displaced along the curved cylinder in response to such fluid pressures. Clearly, this known system constitutes a complicated arrangement, which requires the production of complex curved cylindrical voids to be created within a portion of the machine.

In other known arrangements for achieving compensation for imbalance of a rotating machine part, heating or cooling means are employed to establish a temperature differential between respective ones of the balancing chambers which contain the mass fluid. In these known systems, a warmer chamber loses mass to a cooler chamber. This known type of balancing system involves complicated arrangements for providing energy to thermal devices in the chambers. Such thermal systems are inherently slow to respond and difficult to control in closed loop configurations. In some known systems, electromagnetic energy for energizing the thermal devices is transmitted across an air gap which separates stationary and rotating portions by means of selective energization of primary and secondary coils.

In still further known balancing arrangements, apertures associated with respective balancing chambers are provided on the spinning face of the machine part, and nozzles are located near the apertures, such that a fluid is squirted by the nozzles through the apertures and into the chambers needing the additional mass of the fluid to achieve a balanced state. A timing arrangement controls the operation of the nozzle. This known arrangement, however, is complicated in its implementation. Moreover, when the machine part is no longer rotated, the fluid flows out of drain holes which are associated with respective ones of the apertures. Thus, in addition to the complicated implementation, this known system suffers from the further disadvantage of releasing the fluid into the work area, causing rusting of the equipment and rendering difficult cleanup of the work area.

As is evident from the foregoing, a variety of problems exist in prior art systems. For example, the known fluid balancing systems squirt fluid after the machine element is rotating, and therefore do not provide correction for imbalance at the beginning of each start cycle. With respect to those known arrangements which require an injected liquid, the liquid generally will run out of a system each time rotation of the machine part is stopped. There is therefore a need for a fluid balancing system wherein the distribution of the balancing fluid in the respective balancing chambers remains intact as the machine element is stopped.

It is, therefore, an object of this invention to provide a system for balancing a rotating machine part without loss of the balancing, or mass, fluid into the work area.

It is another object of this invention to provide a system for balancing a rotating machine part without the need of complex machining to be performed on the rotating part.

It is also an object of this invention to provide a system for balancing a rotating machine part which is entirely closed to prevent contamination of the mass fluid as it is transferred into and out of the several balancing chambers.

It is a further object of this invention to provide a system for balancing a rotating machine part which does not require heating or cooling means for creating differential temperatures between adjacent balancing chambers on the rotating machine part.

It is additionally an object of this invention to provide a system for balancing a rotating machine part wherein the quantum of balancing fluid distributed amongst the balancing chambers is controlled.

It is yet a further object of this invention to provide a system for balancing a rotating machine part wherein the distribution of the balancing fluid amongst the balancing chambers will remain undisturbed when the rotating machine part is stopped and restarted.

SUMMARY OF THE INVENTION

The foregoing and other objects are achieved by this invention which provides, in a first apparatus aspect thereof, a balancer arrangement for a rotating machine element, the balancer arrangement being of the type which employs a mass balancing fluid which is deposited into a plurality of balancing chambers associated with the rotating machine element. In accordance with a first apparatus aspect of the invention, the balancer arrangement is provided with a plurality of peristaltic pumps, disposed on the rotating machine element in a balanced arrangement. Each of the peristaltic pumps has a rotatable impeller associated therewith. A plurality of tubes are provided for transferring the mass balancing fluid between respectively associated pairs of the balancing chambers. The tubing is formed of a flexible material with first and second ends, and a central portion therebetween, the central portion being disposed in communication with the rotatable impeller of an associated one of the peristaltic pumps. The first and second ends of the flexible tubing are arranged in respective ones of the associated pair of balancing chambers.

In one highly advantageous embodiment of the invention, the peristaltic pumps are two in number, and arranged to be diametrically opposed from one another. Preferably, the impellers of the peristaltic pumps are arranged to rotate in a plane which is parallel to the plane of rotation of the rotating machine element. The rotatable impeller is affixed, in some embodiments of the invention, to the armature of a pump motor. In other embodiments, however, the impeller may be affixed to the housing of the pump motor. In either case, the rate of rotation of the rotatable impeller of each peristaltic pump is directly a function of the rate of rotation of the pump motor.

In one embodiment of the invention, the tubing which transfers the mass fluid between respective chambers in a pair of such chambers has a non-circular cross-section. Such a non-circular cross-sectional configuration improves the communication between the tubing and the impeller of the peristaltic pump, which may have correspondingly configured rollers at the points of communication with the flexible tubing. In addition, the tubing may be disposed in a respective cavity of the rotating machine element, for achieving a compact design, securing the tubing against centrifugal forces, and preventing ballooning of the tubing. Such a cavity may be in the form of a groove in the periphery of the rotating machine element.

As previously noted, the peristaltic pump may be located in a chamber of the rotating machine element, so as not to protrude outward of the machine element significantly in the axial direction. However, in other embodiments, tile peristaltic pumps may be disposed beyond the outer periphery of the rotating machine element, and beyond the outer perimeter of the balancing chambers. In this manner, it is ensured that the balancing fluid is directed outward, by operation of centrifugal force, to the peristaltic pumps, such that the pumps are always primed during machine operation.

As the balancing fluid is transferred between respective pairs of the balancing chambers, one balancing chamber in a pair may become pressurized, while the other loses air pressure. In some embodiments, this is corrected by providing a capillary passageway between the balancing chambers, and preferably near the vicinity of the center of rotation, for providing air pressure equalization. The capillary passageway may be provided with a valve for opening and closing same, as required.

In preferred embodiments of the invention, tile rotating machine element has at least two diametrically opposed balancing chambers, and an associated peristaltic pump with interconnecting tubing for transferring the balance fluid between such chambers. Of course, other embodiments of the invention may have more balancing chambers, preferably an even number n, in which case, there are provided n/2 peristaltic pumps. Such paired embodiments are inherently easier to balance in a static mode and to control during operation.

In accordance with a further apparatus aspect of the invention, there is provided a balancer arrangement for a rotating machine element, wherein the balancer arrangement is of the type which employs a mass balancing fluid deposited into, and withdrawn from, respective ones of a pair of opposed balancing chambers in the rotating machine element. In accordance with the invention, a peristaltic pump is arranged in a balanced arrangement on the rotating machine element, the peristaltic pump being provided with a motor having an armature portion and a magnetic field/housing portion, and a rotatable impeller coupled to the selected one of the armature and housing portions of the motor. A tube transfers the mass balancing fluid between a respectively associated pair of a balancing chambers in response to a respectively associated one of the peristaltic pumps. The tube is formed of a flexible material and has first and second ends with a central portion therebetween. The first and second ends of the tube are arranged in respective ones of the pair of the balancing chambers, and a central portion thereof is disposed in communication with the rotatable impeller of the peristaltic pump.

In one embodiment of this further aspect of the invention, there is provided an air equalization arrangement for equalizing the air pressure between the balancing chambers. As previously indicated, such air equalization may be achieved by a capillary passage tube arrangement which interconnects the balancing chambers. There is further provided a control arrangement for controlling the operation of the motor of the peristaltic pump. Such operation may take the form of predetermined control states, which corresponds to the possible modes of operation of the motor of the peristaltic pump.

Electrical energy for providing operating power to the peristaltic pump is provided by a power supply arrangement. Such an arrangement may take the form of slip-rings, or one of several other known arrangements for transferring electrical energy to a rotating part. A preferred arrangement for delivering electrical power employs an alternator having an armature portion associated with the rotating shaft of the rotating machine element, and a non-rotating stator arranged therearound.

BRIEF DESCRIPTION OF THE DRAWING

Comprehension of the invention is facilitated by reading the following detailed description, in conjunction with the annexed drawing, in which.

DETAILED DESCRIPTION

Figure 1B:
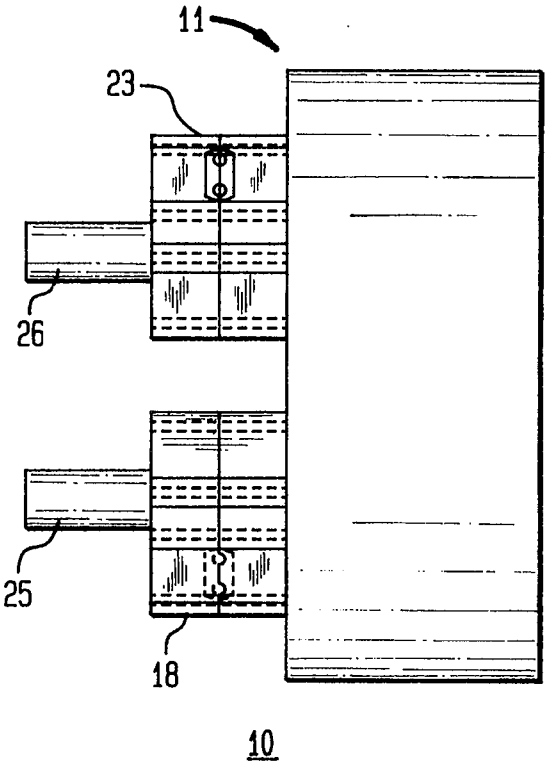
FIG. 1B is a side view of the embodiment depicted in the schematic representation of FIG. 1A.
Figure 1A:
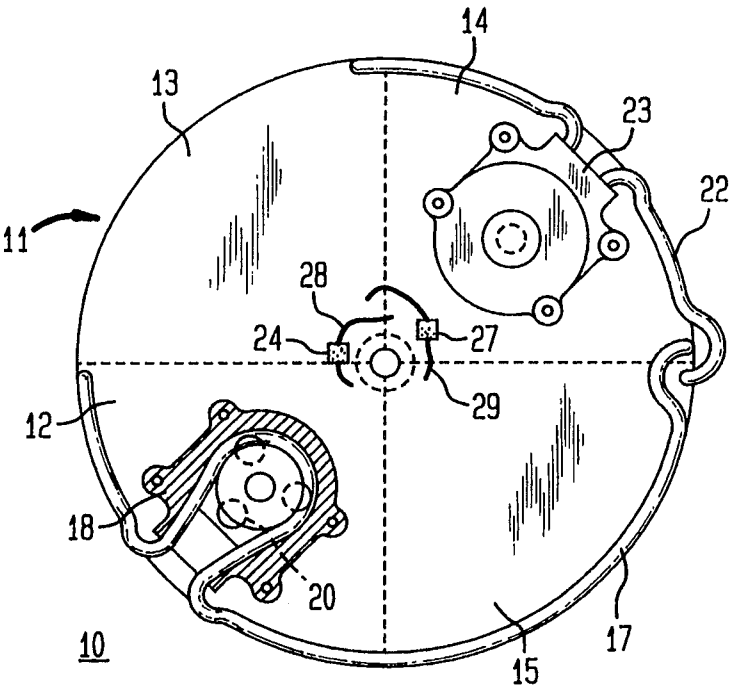
FIG. 1A is a partially cross-sectional plan schematic representation of a specific illustrative embodiment of the invention.

FIG. 1A is a schematic, partially cross-sectional plan view of a balancing arrangement 10 having a rotatable housing 11. Rotatable housing 11 has four balancing chambers, 12–15. The balancing chambers are arranged as pairs 12–14 and 13–15. Balancing chambers 12 and 14 are interconnected by a tube 17 which passes through a pump 18. Pump 18 is shown in this figure in cross-section so as to illustrate that it is a peristaltic pump having three pump rollers 20. Similarly, balancing chambers 13 and 15 are connected to one another by a tube 22 which passes through a pump 23. Pump 23 is, in this embodiment, identical to pump 18.

FIG. 1B is a side view of the structure illustrated in FIG. 1A. As shown in FIG. 1B, pumps 18 and 23 are provided with respective drive motors 25 and 26. The drive motors are reversible, illustrative by changing the polarity of the electrical power provided thereto. In operation, the balancing chambers are partially filled with water or some other fluid (not shown) which does not react with the tubing or the material from which rotatable housing 11 is formed. Of course, a variety of materials are available, such as silicone for the tubing, and aluminum for the rotatable housing. Electrical power to drive motors 25 and 26 is supplied through any number of known arrangements, including slip-rings (not shown). An arrangement which does not provide slip-rings will be described hereinbelow.

As pumps 18 and 23 are operated to cause exchange of fluid between their respective balancing chambers, air pressure differentials may be developed amongst the balancing chambers. If the pressure is not equalized, an additional load will be imposed on the drive motors. Accordingly, in this specific embodiment, the air pressure is equalized by capillary passageways 28 and 29. As shown in FIG. 1A, capillary passageway 28 interconnects balancing chambers 12 and 14, and capillary passageway 29 interconnects balancing chambers 13 and 15. In addition, each such capillary passageway has an associated one of valves 24 and 27, for opening and closing same.

Balancing arrangement 10 can be attached to a rotating machine part, such as a grinding wheel (not shown) to serve as an automatic balancing system.

Figure 2:
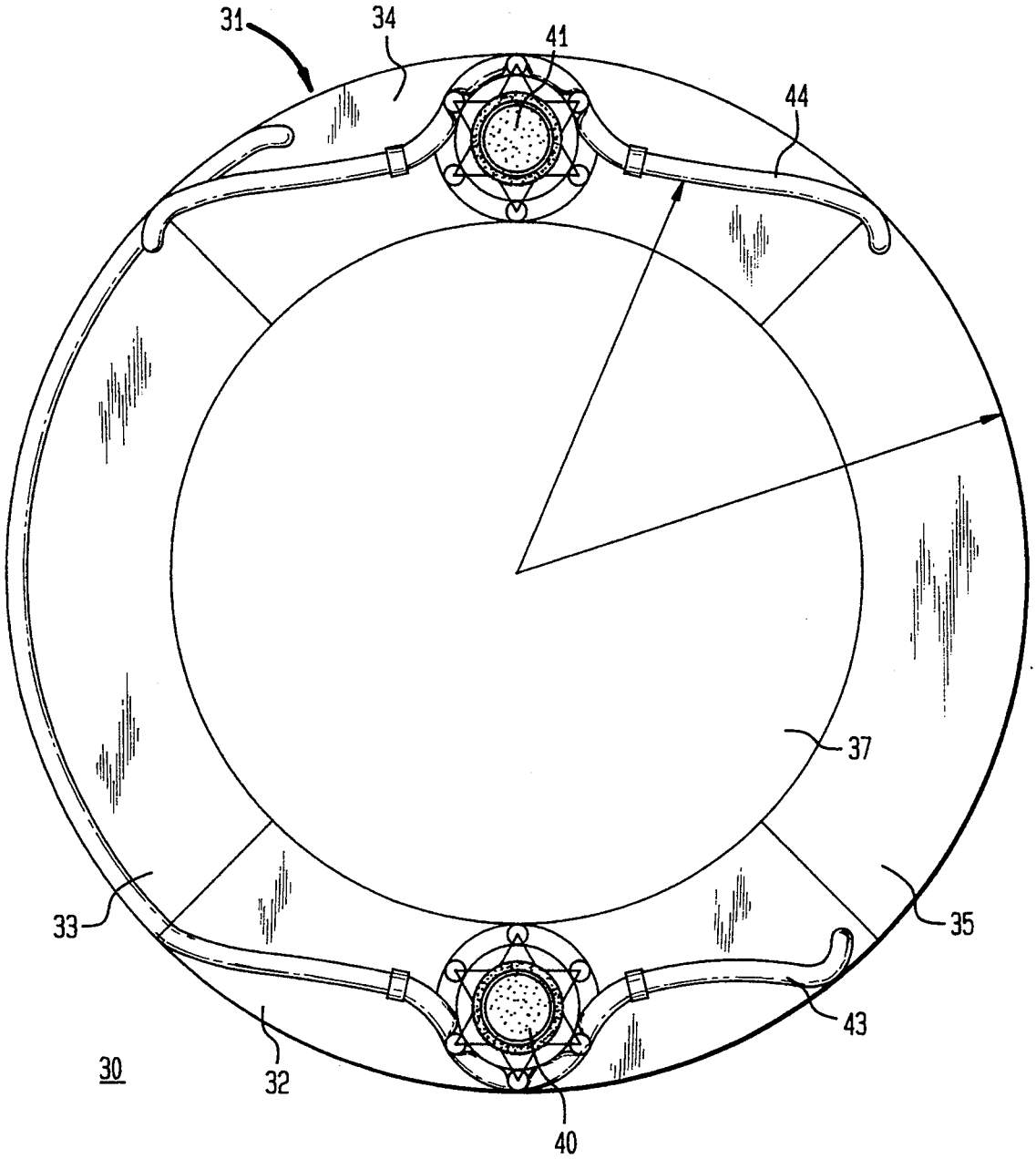
FIG. 2 is a simplified schematic representation of a specific embodiment of the invention wherein two peristaltic pumps control the flow of mass fluid amongst four balancing chambers, wherein the fluid is pumped in the vicinity of the maximum radius of the rotating machine part.

FIG. 2 is a simplified schematic representation of a further illustrative embodiment of the invention. As shown, a balancing arrangement 30 is provided with an annular rotatable housing 31 forming balancing chambers 32–35. Annular rotatable housing 31 has a circular opening 37 which permits the balancing arrangement to be installed over a spindle (not shown). The embodiment of FIG. 2 is shown to have peristaltic pumps 40 and 41 having impellers with more than three pump rollers. More specifically, each of pumps 40 and 41 is shown to have a respective impeller arrangement with six rollers. The additional rollers provide the advantage that the fluid (not shown) in tubes 43 and 44 need not be pulled inward towards the axis of rotation as would otherwise be required. Thus, less torque is required for pumping the fluids between the balancing chambers. In addition, load torque is further reduced by designing the critical fit between the pump rollers and the housing such that the tubing is not squeezed too tightly by the peristaltic pump rollers.

Figure 3:
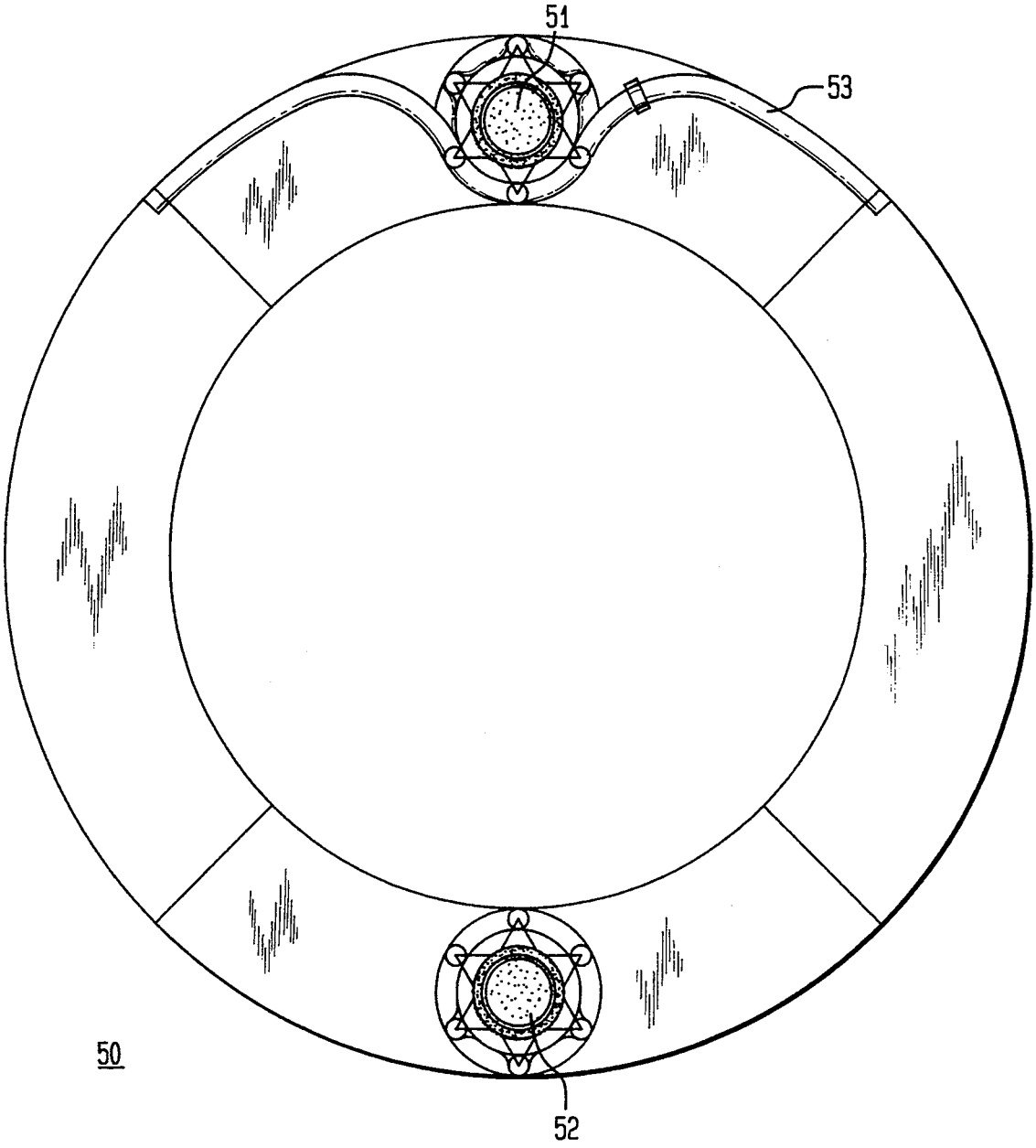
FIG. 3 is a simplified schematic representation which illustrates the fluid being pumped by a peristaltic pump at a shorter radius than in the embodiment of FIG. 2.

FIG. 3 is a simplified schematic plan representation of a balancing arrangement 50 which is similar to the embodiment described with respect to FIG. 2, except that peristaltic pumps 51 and 52 are arranged to pump the fluid (not shown) by operating on the tubing at a shorter radius with respect to the center of rotation. As shown, tube 53 is curved towards the center of rotation so as to engage the radially inward ones of the pump rollers.

Figure 4:
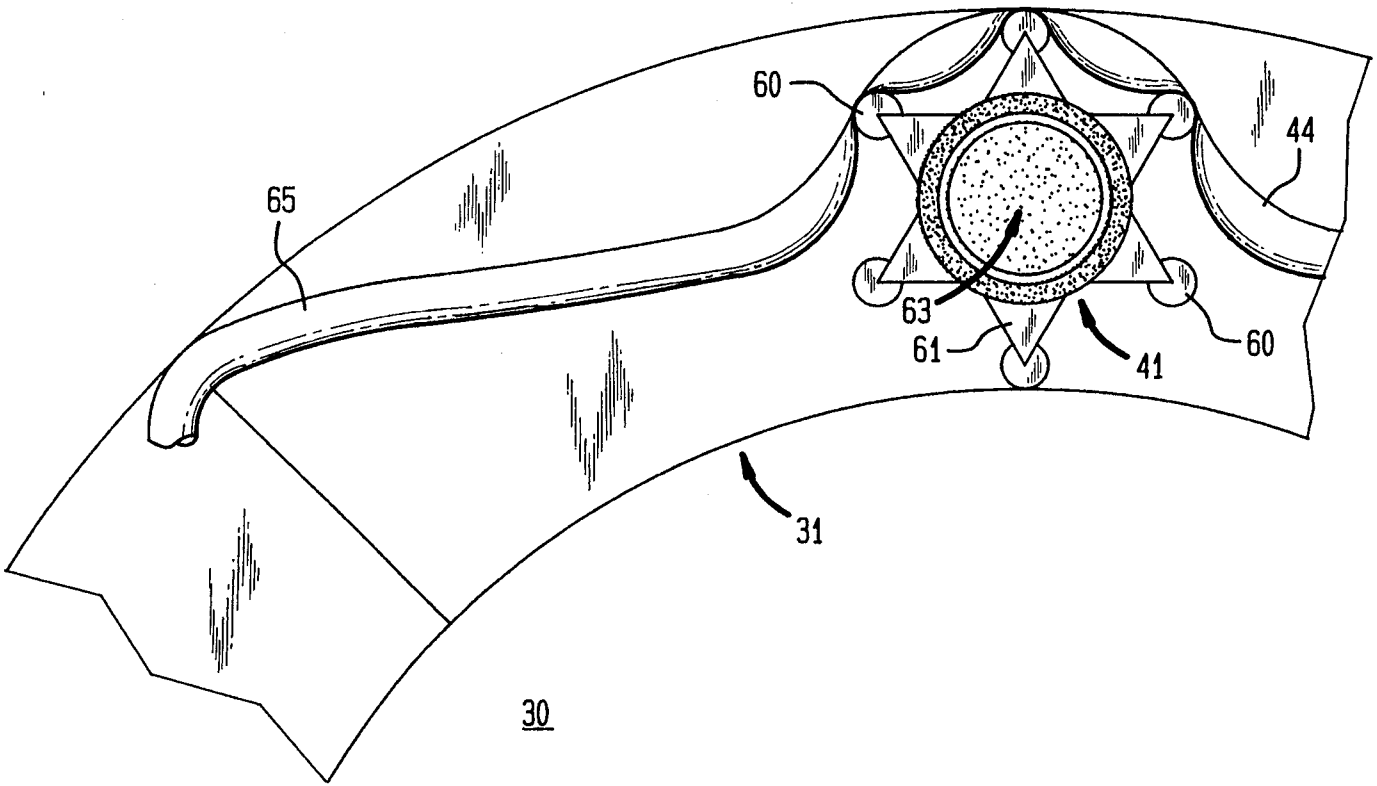
FIG. 4 is a simplified schematic representation of a peristaltic pump wherein the pump rollers are attached to the motor magnetic field housing and frame, and the tube which carries the fluid is contained within a groove or cavity.

FIG. 4 is an enlarged, detailed representation of the embodiment of FIG. 2. Peristaltic pump 41 is of the type which, as will be described herein below, utilizes a plurality of pump rollers 60 installed on a roller carriage 61 attached to the motor frame (not specifically shown in this figure). In this embodiment, roller 6 1 and the motor frame (not shown) rotate about a motor armature 63. Motor armature 63 is affixed to annular rotatable housing 31, so as not to be rotatable with respect thereto.

In this specific embodiment, tube 44 is disposed in a groove 65. Tubing 44 need not have a circular cross-section, and in fact, a flat cross-section will require lower torque output from a motor. Additionally, the tubing need not be compliant or elastic. A non-compliant/flaccid material with thinner walls may be used. Groove 65 serves to prevent the tubing from ballooning, and may be configured to a cross-sectional shape which corresponds to the cross section of the tubing. Thus, for example, in embodiments where tubing 44 is cross-sectionally round, so may the groove be. Moreover, the groove may be partially closed cross-sectionally to ensure that the tubing remains therein during operation of the machine.

Figure 5:
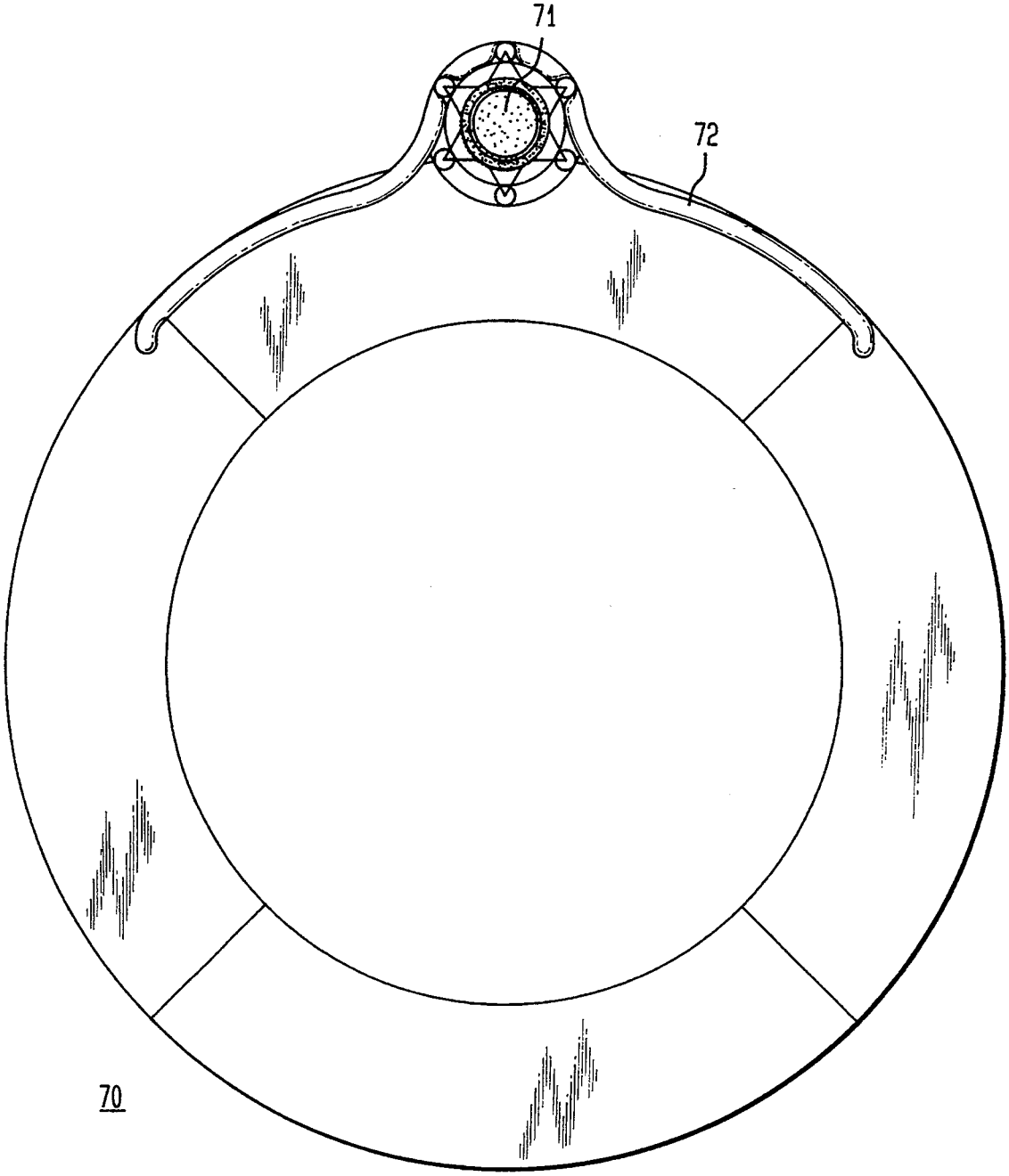
FIG. 5 is a simplified schematic representation showing the peristaltic pump and a corresponding portion of the tube which carries the fluid arranged at a greater radius than the maximum radius of the rotating machine part.

FIG. 5 is a simplified schematic plan representation of a specific embodiment of the invention. As shown, a balancing arrangement 70 is similar to those described hereinabove except that a peristaltic pump 71 is disposed radially outward. Such a radially outward location for the peristaltic pump ensures that tubing 72 will stay inflated. In addition, the use of a groove or cavity for holding the tubing permits the use of a thin-walled tubing. Such a tubing will reduce the load on the motor.

Figure 6:
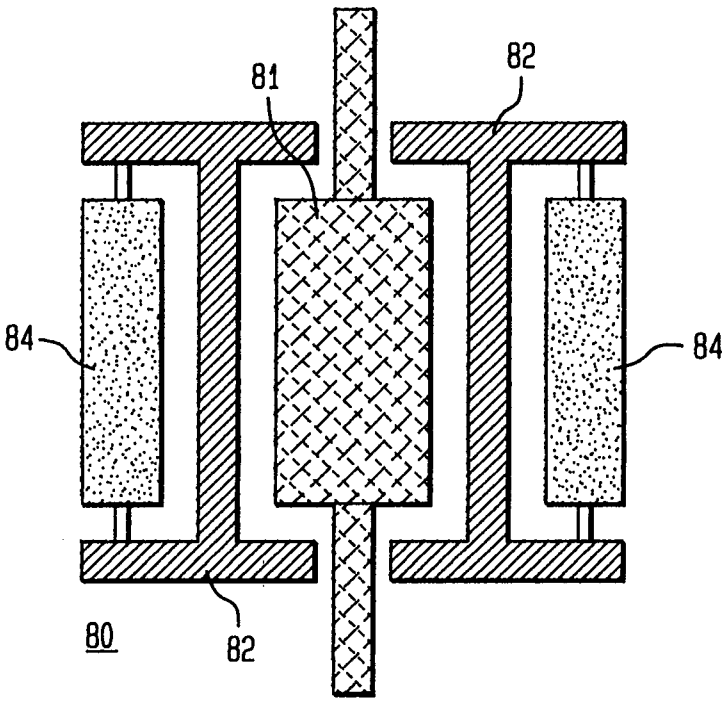
FIG. 6 is a schematic representation of a motor for a peristaltic pump wherein the pump rollers and their corresponding assembly are attached to the motor housing.

FIG. 6 is a schematic representation of a peristaltic pump motor arrangement 80 having an armature 81 and a housing 82. A plurality of pump rollers 84 are shown coupled to housing 82. This type of arrangement reduces the length of the pump-motor combination. The armature is held stationary while the housing is allowed to rotate.

Figure 7:
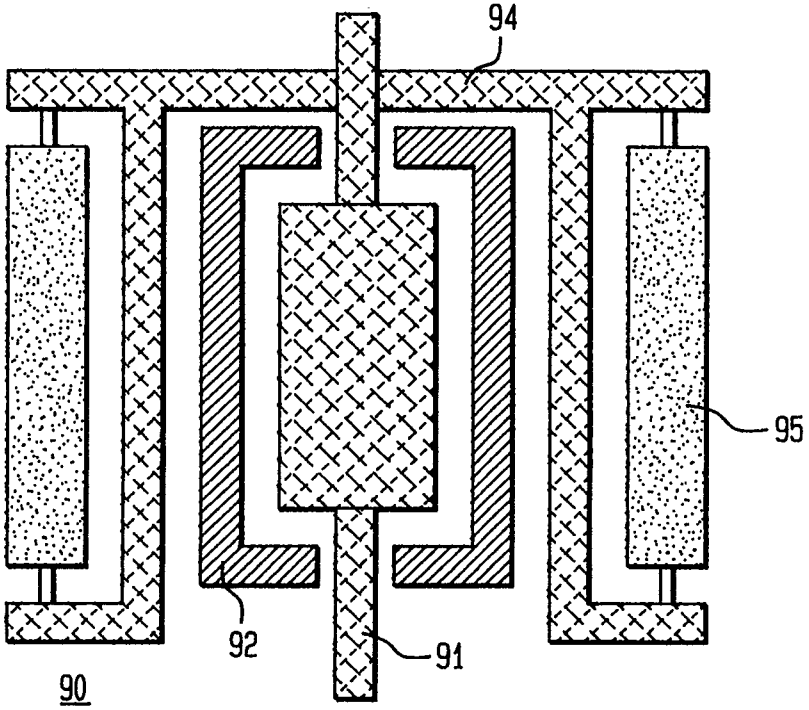
FIG. 7 is a schematic representation of a motor for a peristaltic pump wherein the pump rollers and their corresponding assembly are affixed to the motor shaft.

FIG. 7 is a schematic representation of a motor arrangement 90 wherein a motor shaft 91 rotates within a field winding at housing 92. As shown, a roller carriage 94 is coupled to shaft 91 so as to rotate therewith. In this manner, pump rollers 95 rotate about motor shaft 91.

Figure 8:
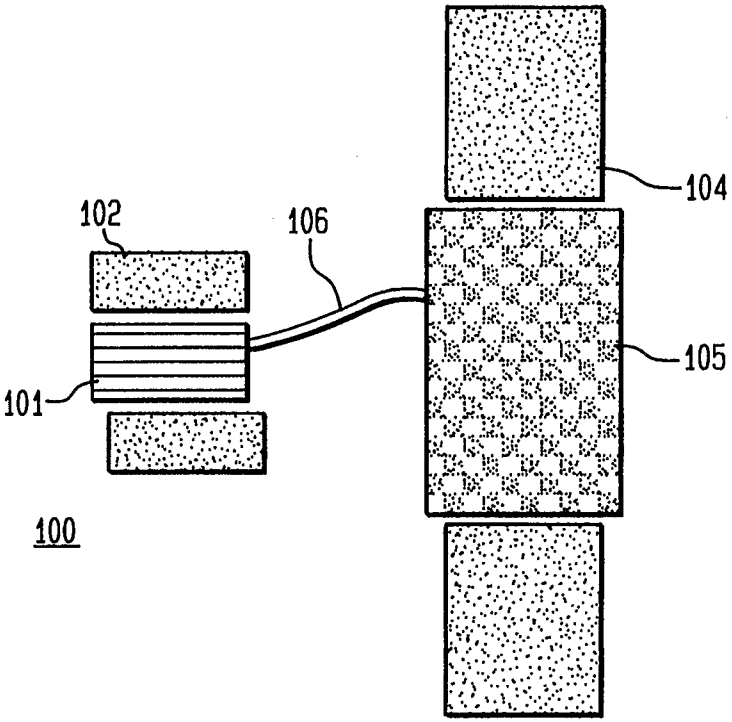
FIG. 8 is a schematic representation of an arrangement which is useful for delivering electrical energy to the peristaltic pump drive motors.

FIG. 8 is a schematic representation of an arrangement for generating the power needed for operating the pump motors (not shown in this figure) using an alternator 100 having a wound rotor 101 and a permanent magnet stator 102. Rotor 101 is arranged on the same shaft as a grinding wheel 104 which, in this embodiment, is shown to be installed on a balancing arrangement 105. Balancing arrangement 105 may be of a type described hereinabove.

The amplitude and the frequency of the AC voltage generated by alternator 100 is determined by the grinding wheel speed. However, the variations of amplitude and frequency with the changing speed of the grinding wheel are irrelevant because the AC power is converted to DC by rectification and filtering circuits (not shown) mounted on balancer 105. Since alternator 100 and grinding wheel 104 are mounted on the same shaft (not specifically shown), there is no relative motion between the two, and therefore a direct solid connection 106 is possible.

Figure 9B:
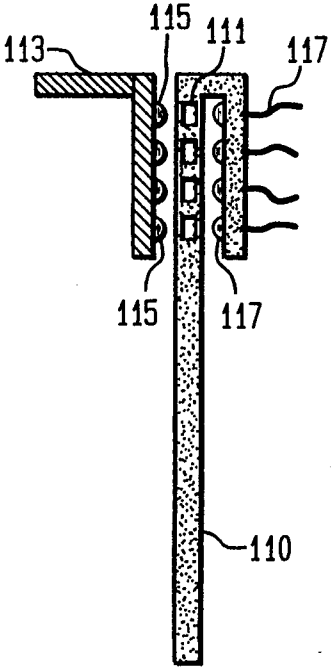
FIGS. 9A and 9B are schematic representations of an arrangement for delivering logic codes to the peristaltic pumps for initiating specific states of operation.
Figure 9A:
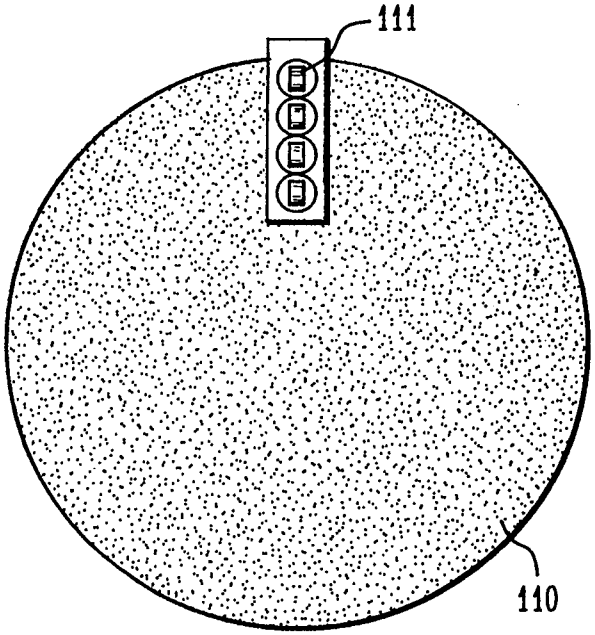

FIGS. 9A and 9B illustrate an arrangement by which control signals can be delivered to control the operation of the peristaltic pumps in an embodiment of the invention having two peristaltic pumps. First, it is to be understood that there are nine possible control states. These are set forth in Table 1, as follows:

TABLE 1

LOGICAL CONTROL STATES FOR THE BALANCER

| Motor #1 | | Motor #2 | | Coded States | | | |
|---|---|---|---|---|---|---|---|
| Power | Direction | Power | Direction | $D_2$ | $P_2$ | $D_1$ | $P_1$ |
| OFF | X | OFF | X | 0 | 0 | 0 | 0 |
| ON | CW | OFF | X | 0 | 0 | 0 | 1 |
| ON | CCW | OFF | X | 0 | 0 | 1 | 1 |
| OFF | X | ON | CW | 0 | 1 | 0 | 0 |
| OFF | X | ON | CCW | 1 | 1 | 0 | 0 |
| ON | CW | ON | CW | 0 | 1 | 0 | 1 |
| ON | CCW | ON | CW | 0 | 1 | 1 | 1 |
| ON | CW | ON | CCW | 1 | 1 | 0 | 1 |
| ON | CCW | ON | CCW | 1 | 1 | 1 | 1 |

$P_i = 0$ if $i^{th}$ motor is to be idle
$P_i = 1$ if $i^{th}$ motor is to be active
$D_i = 0$ if $i^{th}$ motor is to be idle or turn cw
$D_i = 1$ if $i^{th}$ motor is to turn ccw
$i = 1,2$ The arrangement of FIGS. 9A and 9B comprise an optical encoder which may be used to send the logic information to the balancer arrangement (not shown in this figure). In the present implementation, a disk 110 is shown in FIG. 9A to have four narrow slots 111 along a radial line. In this embodiment, the disk may be mounted on the same shaft (not shown) as alternator rotor 101, shown in FIG. 8. FIG. 9B shows an arm 113 carrying four light sources 115 which are aligned with the four slots 111 in the disk. In this specific embodiment, arm 113 may be coupled rigidly to alternator stator 102, and therefore does not rotate with disk 110.

Light sources 115 are turned on or off according to a desired control state, which control states are set forth in Table 1, hereinabove. A plurality of photo sensors 117 read the logic state information once per revolution of disk 110, which is also one revolution of the grinding wheel (not shown). This information is used by a logic decoding circuit (not shown) in the balancer which controls the pump motors (not shown in this figure). The four photo sensors yield sixteen possible states, yet only nine are needed to control the motor. These additional states may be used to pass additional intelligence to a motor controller (not shown) inside the balancing arrangement. Of course, additional slots and sensors may be used as desired, and the implementation of same, in light of the present teaching, would be within the abilities of persons of ordinary skill in the art.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof.

What is claimed is:

1. A balancer arrangement for a rotating machine element, the balancer arrangement being of the type which employs a mass balancing fluid which is deposited into a plurality of balancing chambers associated with the rotating machine element, the balancer arrangement comprising:

a plurality of peristaltic pump means disposed in a balanced arrangement on the rotating machine element, each of said peristaltic pump means being provided with a rotatable impeller; and a plurality of tubing means each for transferring the mass balancing fluid between a respectively associated pair of the balancing chambers in response to a respectively associated one of said peristaltic pump means, said tubing means each being formed of a flexible material and having first and second ends and a central portion therebetween, said first and second ends being disposed in respective ones of the associated pair of the balancing chambers, and said central portion between said first and second ends being disposed in communication with said rotatable impeller of said respectively associated one of said peristaltic pump means.

2. The balancer arrangement of claim 1 wherein there are provided four balancing chambers in the rotating machine element, said plurality of peristaltic pump means comprising two peristaltic pumps disposed diametrically opposed to one another.

3. The balancer arrangement of claim 2 wherein said plurality of tubing means comprises two flexible tubes, said first and second ends of each such flexible tubes being disposed in diametrically disposed ones of the balancing chambers.

4. The balancer arrangement of claim 1 wherein said rotatable impellers of said plurality of peristaltic pump means are arranged to rotate in a plane which is parallel to the plane of rotation of the rotating machine element.

5. The balancer arrangement of claim 1 wherein each of said peristaltic pump means comprises a pump motor having a motor armature and a magnetic field/housing, said rotatable impeller being coupled to said motor armature, so as to be rotatable therewith.

6. The balancer arrangement of claim 1 wherein each of said peristaltic pump means comprises a pump motor having a motor armature and a magnetic field/housing, said rotatable impeller being coupled to said field winding housing, so as to be rotatable therewith.

7. The balancer arrangement of claim 1 wherein said peristaltic pump means is arranged within a cavity in said rotating machine element.

8. The balancer arrangement of claim 1 wherein said tubing means each have a non-circular cross-section.

9. The balancer arrangement of claim 1 wherein said peristaltic pump means is arranged on said rotating machine element to extend radially beyond a maximum radius of the rotating machine element.

10. The balancer arrangement of claim 1 wherein said tubing means is disposed within a cavity in the rotating machine element for preventing ballooning of said tubing means.

11. The balancer arrangement of claim 10 wherein said cavity in the rotating machine element comprises a groove in the periphery of the rotating machine element.

12. The balancer arrangement of claim 1 wherein there are provided an even number n of the balancing chambers, and there are provided n/2 peristaltic pump means.

13. The balancer arrangement of claim 1 wherein there is further provided a plurality of roller members arranged on each rotatable impeller for communicating with said tubing 14. The balancer arrangement of claim 1 wherein there is further provided capillary passage means for equalizing an air pressure between opposed ones of the balancing chambers.

15. The balancer arrangement of claim 14 wherein said capillary passage means is provided with valve means for opening and closing same.

16. A balancer arrangement for a rotating machine element, the balancer arrangement being of the type which employs a mass balancing fluid deposited into a pair of opposed balancing chambers in the rotating machine element, the balancer arrangement comprising:

a peristaltic pump disposed in a balanced arrangement on the rotating machine element, said peristaltic pump being provided with:

a motor having an armature portion and a housing portion; and a rotatable impeller coupled to a selected one of said armature and housing portions of said motor;

a tube for transferring the mass balancing fluid between a respectively associated pair of the balancing chambers in response to a respectively associated one of said peristaltic pump means, said tube being formed of a flexible material and having first and second ends and a central portion therebetween, said first and second ends being disposed in respective ones of the pair of the balancing chambers, and said central portion between said first and second ends being disposed in communication with said rotatable impeller of said peristaltic pump.

17. The balancer arrangement of claim 16 wherein there is further provided air equalization means for equalizing an air pressure between the balancing chambers.

18. The balancer arrangement of claim 17 wherein said air equalization means comprises a capillary passageway arranged to interconnect the balancing chambers.

19. The balancer arrangement of claim 16 wherein there is further provided control means for controlling the operation of said motor of said peristaltic pump.

20. The balancer arrangement of claim 19 wherein said control means provides a plurality of predetermined control states.

21. The balancer arrangement of claim 16 wherein there is further provided power supply means for providing electrical power to said motor of said peristaltic pump.

* * * * *